US009371985B2

(12) United States Patent
Kowalchuk

(10) Patent No.: US 9,371,985 B2
(45) Date of Patent: Jun. 21, 2016

(54) IMPLEMENT FOR THE SITUATION AND MAINTENANCE OF SOLID OBJECTS OVERTOP OF A LIGHTING DEVICE'S OUTER SURFACE

(71) Applicant: Collin Maximillian Kowalchuk, Aradas (PT)

(72) Inventor: Collin Maximillian Kowalchuk, Aradas (PT)

( * ) Notice: Subject to any disclaimer, the term of this patent is extended or adjusted under 35 U.S.C. 154(b) by 70 days.

(21) Appl. No.: 14/510,143

(22) Filed: Oct. 9, 2014

(65) Prior Publication Data

US 2016/0102855 A1 Apr. 14, 2016

(51) Int. Cl.

| | |
|---|---|
| ***F21V 15/00*** | (2015.01) |
| ***F21V 33/00*** | (2006.01) |
| ***B65D 25/10*** | (2006.01) |
| ***B65D 43/14*** | (2006.01) |

(52) U.S. Cl.

CPC ..... *F21V 33/0004* (2013.01); *B65D 25/10* (2013.01); *B65D 43/14* (2013.01)

(58) Field of Classification Search

CPC ..... H01J 61/045; H01J 61/327; Y02B 20/19; F21V 17/002; F21V 17/02; F21V 17/06; F21V 17/18

USPC ..... 362/374, 378, 644

See application file for complete search history.

(56) References Cited

U.S. PATENT DOCUMENTS

| | | | | |
|---|---|---|---|---|
| 693,460 | A | 2/1902 | Takaba | |
| 1,042,979 | A * | 10/1912 | Seessle | F21V 17/04 340/321 |
| 1,333,569 | A * | 3/1920 | Papemaier | F21V 15/02 362/378 |
| 2,174,937 | A | 10/1939 | Dietz | |
| 2,418,131 | A | 4/1947 | Margolis | |
| 2,720,056 | A | 10/1955 | Levy | |
| 3,662,165 | A | 5/1972 | Grindle | |
| 4,453,203 | A | 6/1984 | Pate | |
| 5,287,259 | A | 2/1994 | Lautzenheiser | |
| 5,600,909 | A | 2/1997 | Hooper | |
| 6,783,262 | B2 | 8/2004 | Orfield | |
| D680,680 | S * | 4/2013 | Barenboim | D26/119 |
| 2012/0313521 | A1 | 12/2012 | Roberts | |
| 2013/0148358 | A1 | 6/2013 | Harooni | |

FOREIGN PATENT DOCUMENTS

| | | |
|---|---|---|
| JP | WO03085319 A1 | 10/2003 |

* cited by examiner

*Primary Examiner* — Andrew Coughlin

(57) ABSTRACT

A device is described that can be situated with one or more solid objects within overtop of a lighting device's outer surface. A container component contains one or more cavities that can be accessed via one or more openings. The one or more solid objects can be inserted into said cavity through the one or more openings. A closure component covers one or more of said openings and thereby restricts access to said cavity. A banding device that comprises one or more banding implements provides a means to maintain the container component, the closure component, the banding device itself and said one or more solid objects with in the cavity in said situated location. The container component, closure component and banding device are fabricated from a material that is appropriate for a maintenance in said situated location.

5 Claims, 8 Drawing Sheets

IMPLEMENT FOR THE SITUATION AND MAINTENANCE OF SOLID OBJECTS OVERTOP OF A LIGHTING DEVICE'S OUTER SURFACE

CROSS-REFERENCE TO RELATED APPLICATIONS

Related applications have been filed by the aforementioned author:

USPTO Provisional Patent: U.S. 61/889,044
USPTO Provisional Patent: U.S. 61/889,047

PRIOR ART

Patent Documents

U.S. Pat. No. 693,460 February 1902 Takaba
U.S. Pat. No. 2,174,937 October 1939 Dietz
U.S. Pat. No. 2,418,131 April 1947 Margolis
U.S. Pat. No. 2,720,056 November 1955 Levy
U.S. Pat. No. 3,662,165 May 1972 Grindle
U.S. Pat. No. 4,453,203 June 1982 Pate
U.S. Pat. No. 5,287,259 February 1994 Lautzenheiser
U.S. Pat. No. 5,600,909 May 1995 Hooper
U.S. Pat. No. 6,783,262 August 2004 Orfield
WO2003085319 October 2003 Citterio
20120313521 December 2012 Roberts
20130148358 June 2013 Harooni

BACKGROUND OF THE INVENTION

1. Field

The invention generally relates to a lighting device and more specifically to an implement that is situated and maintained overtop of said lighting device with one or more solid objects within.

2. Prior Art

The rise in popularity of energy saver light bulbs coincident with the phase out of traditional alternatives has left a consumer with only the energy saving option. In regard to the performance of the CFL (Compact Fluorescent Light) and LED (Light Emitting Diode) type light bulbs, many consumers have experienced an early failure rate when compared to the estimated factory longevity. Premature failure often occurs for reasons like those of any complex mass produced, electronically based product where small defects can have catastrophic performance consequences. A warranty is therefore often offered. Very few defective energy saver light bulbs are however returned. This may be explained by the fact that for the most part energy saver lighting devices function in a flawless manner and that after a catastrophic failure the device specific documents can not be attributed. The invention described herein provides a means for situating and maintaining one or more solid objects, typically the device specific documents with each light bulb.

It has long been known that container implements can be situated and maintained in close proximity with lighting devices. For example, Takaba (1902) designed a lamp shade with pockets. Light character modifiers have also been closely maintained, such as filters [Citterio (2003) and Harooni (2013)] or cavities [Hopper (1997)]. These devices are not in direct contact with the lighting device's outer surface and would offer a minimal degree of protection for any inserted solid object. Said insertion would also interfere with the intended operational characteristics of their designs. Other containers such as plant receptacles [Levy (1955)] or the cavities within lamp structures cannot be opened and closed, be readily situated or removed and are also not in direct contact with the lighting device's outer surface. Opaque, reflective devices such as those developed by [Dietz (1936), Margolis (1947), Grindle (1972), Pate (1982), Lautzenheiser (1994), Orfield (2003) and Roberts (2012)] do directly contact the lighting device's outer surface, but do not contain a container into which solid objects can be inserted. The invention described herein allows for different collective functions than those of the prior art with a site for situation directly overtop of the lighting device's outer surface, it can be readily situated or removed and can be opened and closed.

This invention provides a means for one or more solid objects to be situated overtop of a lighting device's outer surface. A container component contains a cavity that can be accessed via one or more openings and through which solid objects can be inserted. A closure component covers one or more of said openings which restricts access to said cavity and thereby access to the solid objects within. A banding device provides a means for said container component, closure component, the one or more solid objects and the banding device itself to be maintained in the situated location. The container component, closure component and banding device are composed of a material, not necessarily of the same type with physical properties that provide: an electrical non-conductivity, a heat resistance, a corrosion resistance, a fracture resistance, a light resistance and an optical opacity, as appropriate for said maintenance within an operational environment of said lighting device. Various lighting devices can provide a platform for said situation including the plurality of, but are not necessarily limited to: a light bulb socket, a ballast of a CFL or a covered CFL device, a heat sink of a LED device or another such device utilized in conjunction with lighting.

SUMMARY

According to the first embodiment an implement is described that provides a means for a situation and maintenance of one or more solid objects overtop of a lighting device's outer surface. Various lighting devices can provide a platform for said situation including the plurality of, but not necessarily limited to: a light bulb socket, a ballast of a CFL or a covered CFL device, a heat sink of a LED device or another such device utilized in conjunction with lighting. A container component contains a cavity that can be accessed through one or more openings. Each opening comprises a non-continuity in the container's surface. The dimensions of at least one of said openings and of said cavity allow for an insertion of said one or more solid objects. A closure component covers one or more of said openings and thereby restricts access to the cavity. A banding device, which comprises one or more types of banding implement provides a means for a generation of contact with the lighting device's outer surface. Following said contact, the banding device can induce a physical tensioned type of interaction which exerts a force sufficient to maintain the container component, closure component, the banding device itself and solid objects in said situated location. The container component, closure component and banding device are composed of a material, not necessarily of the same type with physical properties that provide: an electrical non-conductivity, a heat resistance, a corrosion resistance, a fracture resistance, a light resistance and an optical opacity, as appropriate for said situation and maintenance within an operational environment of said lighting device.

The above brief description sets the more important features of the present invention forth rather broadly. A more detailed description thereof follows and may be better understood as to specific contributions to the art. Additional features described hereinafter will contribute subject matter that appends the claims.

Before explaining the preferred embodiment of the invention in detail, it will be understood that the invention is not limited in its application to the details of the construction and the arrangements of the components set forth in the following description or illustrated in the drawings. The invention can have other embodiments and may be carried about in other ways. The terminology and phraseology employed herein is set forth for the purpose of description and is not intended or should be regarded as limiting.

Skilled individuals will appreciate that this disclosure can be utilized for the details herein for designing or carrying out other structures, methods or systems for purposes of the present invention and therefore the claims are to be regarded as including such equivalent constructions insofar as they do not depart from the spirit of the present invention.

It is therefore an object of this invention, taking into account the above to provide an implement that allows for one or more solid objects to be situated overtop of a lighting device's outer surface.

Another object of the invention is that the implement is fabricated from a material that displays properties appropriate for a maintenance in said situated location.

Yet another object of the invention is that onto the implement, surface finishes and modifiers can be integrated during or post fabrication.

Still another object of the invention is that a container component contains a cavity and into which said solid objects can be inserted.

Another object of the invention is that one or more openings provide a means for access to the cavity.

Another object of the invention is that at least one of said one or more openings has dimensions that allows for said insertion of said one or more solid objects into the cavity.

Another object of the invention is that a closure component interacts with said container component.

Another object of the invention is that a complementary attachment interaction provides a means for an attachment of the container and closure components.

Another object of the invention is that said closure component covers one or more of said openings with said access to the cavity being restricted.

Another object of the invention is that a banding device comprises one or more banding implement types which provide a means for said maintenance of the banding device itself, the container component, the closure components and said one or more solid objects within said cavity at the situated location.

Another object of the invention is that the one or more banding implement types can generate contact with lighting device outer surfaces of a varied size.

Finally, another object of the invention is that one or more of the banding implement types when in contact with the lighting device's outer surface can induce a physical tensioned type of interaction with a force sufficient for said maintenance of the container component, closure component, the banding device itself and the one or more solid objects within said cavity at the situated location.

DRAWINGS

REFERENCE NUMERALS

[1] a light bulb socket
[2] a container component
[3] a closure component
[4] a surface finish on the container component
[5] a surface finish on the closure component
[6] a ballast
[7] a compact fluorescent lighting device (CFL)
[8] one or more solid objects
[9] a cavity
[10] an opening
[11] a container component's threaded connector implement
[12] a closure component's threaded connector component
[13] a flexible type of banding device implement
[14] an inflexible type of banding device implement
[15] flexible banding implement's affixed edge
[16] flexible banding implement's bendable length
[17] flexible banding implement's movable free edge
[18] a base
[19] inflexible banding type implement's angular top limit
[20] a separated alternate embodiment's container component
[21] a separated alternate embodiment's closure component
[22] a separated alternate embodiment's banding device
[23] separated alternate embodiment's cavity
[24] slits incised into the container component
[25] an end-on tab incised into container component
[26] an end-on slit incised into the closure component
[27] a static strip of the banding device
[28] two slots incised into the banding device
[29] a tab of the banding device
[30] two aligned slots incised into both of the container and closure components
[31] a slot incised into the container component
[32] an associated alternate embodiment's container component
[33] an associated alternate embodiment's closure component
[34] an associated alternate embodiment's banding device
[35] connector implement tabs incised into the container component
[36] two aligned slots incised into both of the container and closure components

DETAILED DESCRIPTION

First Embodiment FIGS.

Figure 1:
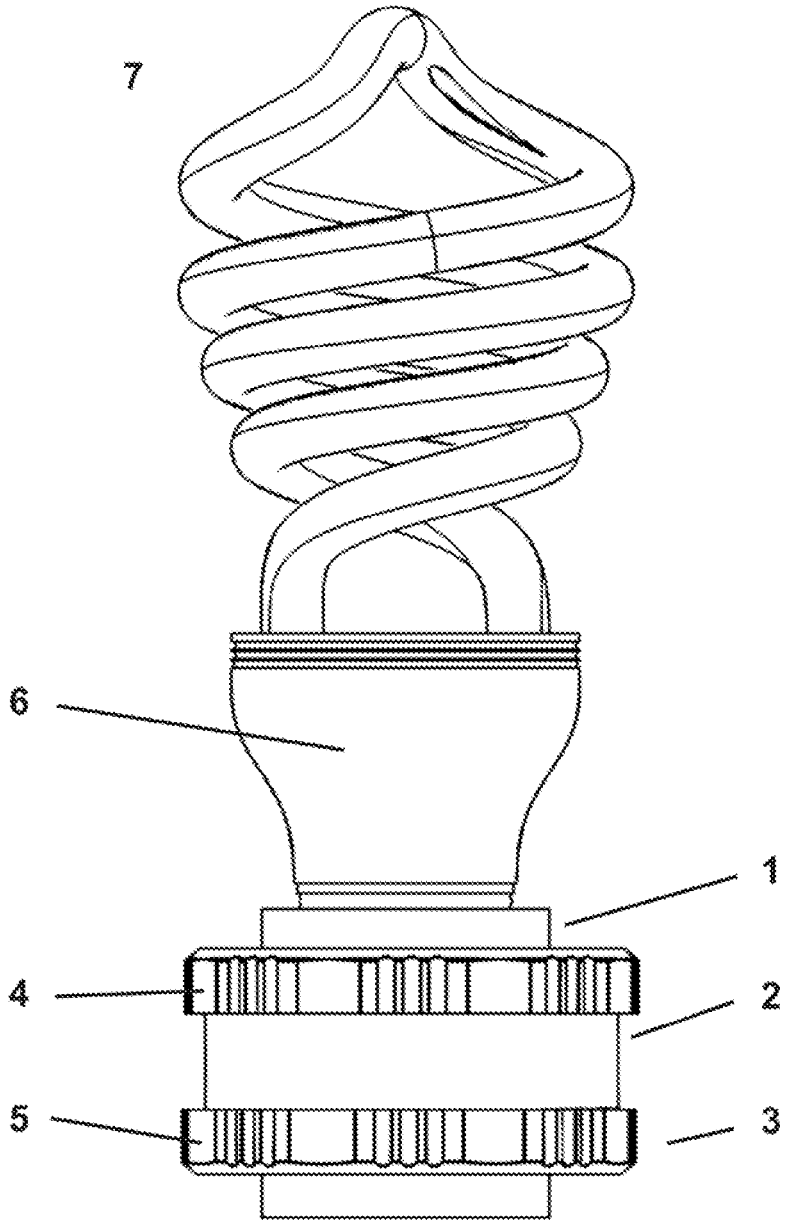
FIG. 1 is a perspective view of the first embodiment situated overtop of the light bulb socket's outer surface.

FIG. 1 is a perspective view of the first embodiment situated overtop of a light bulb socket [1]. A container component [2] and a closure component [3] component are attached to provide a quasi toroid type morphology. A central cylindrical surface dimensional void is sufficient to allow for said situation. Other outer and inner surface morphologies are possible including: spherical, cubic, cylindrical, pyramidal, conical or a combination thereof. A surface finish is integrated with the outer surface of both the container [4] and closure components [5]. A banded surface finish is shown, other surface finishes are however possible including: lay patterns, varied degrees of roughness or irregularities, waviness, be flattened, smoothed or be a combination thereof. Various lighting devices can provide a platform for said situation including the plurality of, but not necessarily limited to: a light bulb socket, [1] a ballast [6] of a CFL [7] or a covered CFL device, a heat sink of a LED device or another such device utilized in conjunction with lighting. Surface modifiers can be integrated with any surface including the plurality of: external surface modifiers such as script, glued or plasticized labels or internal modifiers integrated during fabrication or that result from a post fabrication process such as said surface finishes, thermal or light resistant coatings, raised or recessed lettering or other symbols.

Figure 2:
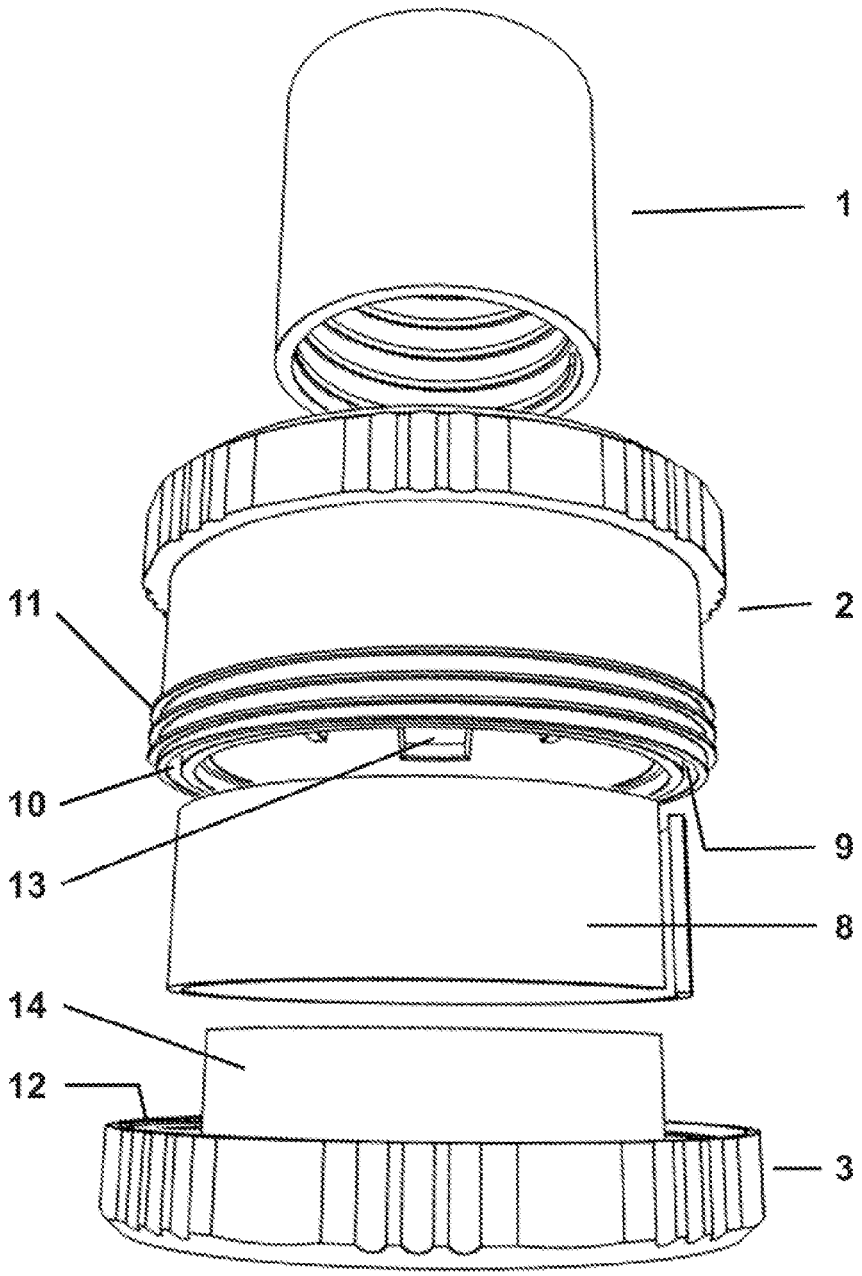
FIG. 2 is a perspective view of the first embodiment unattached and non-situated overtop of the light bulb socket's outer surface with the one or more solid objects shown prior to insertion.

FIG. 2 is a perspective view of the unattached first embodiment in a non-situated state overtop with the light bulb socket's [1] outer surface. The first embodiment is semi-rigid and fabricated from a ABS (acrylonitrile butadiene styrene) in a plastic injection molding process. Other materials and other fabrication processes are possible providing that physical properties can be realized which include, but are not necessarily limited to: an electrical non-conductivity, a heat resistance, a corrosion resistance, a fracture resistance, a light resistance and an optical opacity as appropriate for said situation and maintenance within an operational environment of the lighting device. One or more solid objects [8] have been shaped to allow for an insertion into a cavity [9] through an opening [10] in the container component [2]. Said solid objects can be of the plurality including: paper documents, low volatility aromatics such as an air freshener, heat transfer type materials such as metals, ceramics, plastics or semiconductors, insulator type materials against heat, electricity or cold, desiccants or liquids or gases within a protecting shell that is porous, semi-porous or non-porous. Attachment of the container and closure components is provided by a complementary attachment interaction which comprises threaded connector implements [11,12] integrated with both of the container [2] and closure [3] components. A banding device that comprises a flexible [13] and an inflexible [14] type of banding device implement, provides a means for maintaining the container component, closure component, the banding device itself and one or more solid objects within the cavity at one of the possible situated locations (as shown in FIG. 1).

Figure 3:
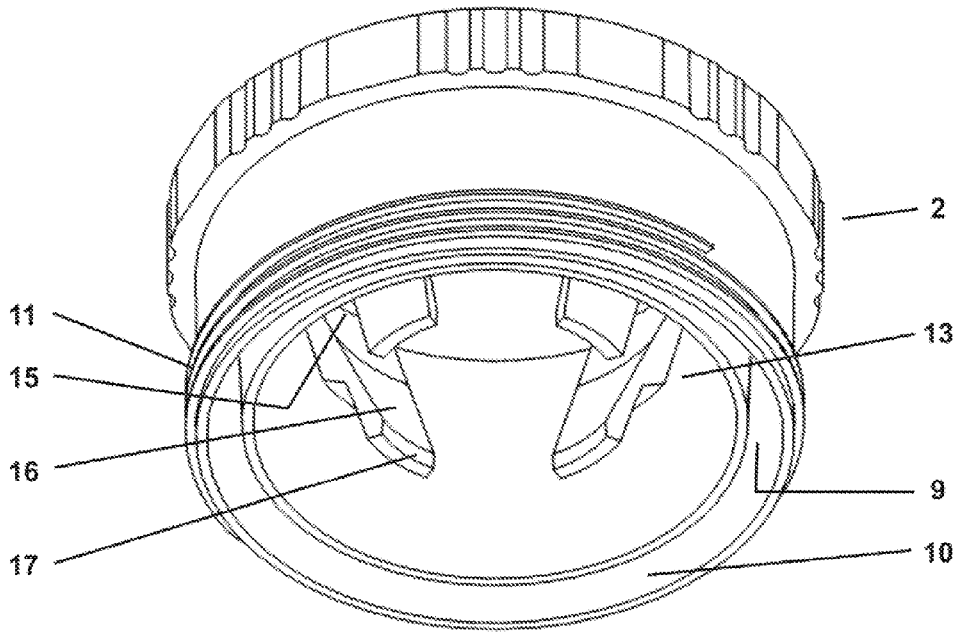
FIG. 3 is a perspective view of the container component and the flexible type of banding device implement.

FIG. 3 is a perspective view of the container component [2] with the attached flexible type of banding device implement [13]. Said construct is formed by a complete or an incomplete attachment of said walls. The cavity [9] is accessed by a means of the opening [10] which comprises a zone of non-continuity where said walls are incompletely attached. The cavity and opening both have dimensions that allow for the insertion of said one or more solid objects (not shown). One or more additional openings can be present within the outer or inner walls (facing away from or toward the situated overtop location of the lighting device's outer surface, respectively) or at the polar opposite position from that shown. Each of said additional openings need not be of a sufficient size to allow for said insertion of said one or more solid objects. One or more additional cavities can also be present by partitioning, repositioning or otherwise dividing the present cavity into segregated components. The flexible type of banding device implement [13] has a tab type morphology which comprises an attached edge [15], a bendable length [16] and a movable free edge [17]. The movable free edge is manipulated to provide a dimensional reductive motion with a generation of contact at the lighting device's outer surface. Said dimensional reductive motion is variable such that said contact can be generated with outer surfaces of different sizes. When said free edges are in contact and stressed, said bendable length [16] deforms in an arced manner which induces a physical tensioned type of interaction. Other banding device implement types can be substituted such as the plurality including one or more: clamps, clips, snaps, friction tabs, clip tabs, tape or glue, snaps, strips whether elastic, static or Velcro®, threaded interactions, another similar mechanism or be a combination thereof. Said physical tensioned type of interaction is of the frictional type however said other types of banding devices can generate a: gravitational, electrostatic, magnetic; chemical interaction or a combination thereof. Said generation of contact and deformational movements are reversible and result from an interaction with said inflexible type of banding device implement (described as a part of the FIG. 2 and FIG. 4 Detailed Description). The flexible type of banding device implement has a shaped surface which provides for an increased vigor of the attached edge's interface with the container component and along the bendable length, an increased contact surface area of the movable free edge with the lighting device's outer surface and an amplified efficiency of said dimensional reductive motion that results from said interaction with the inflexible type of banding device implement. Multiple variations to the shaped surfaces are possible on either or both of the outer or inner facing walls (facing away from or toward the situated overtop location of the lighting device's outer surface, respectively). These variations include, but are not limited to: a height, width, length, thickness or curvature. Additionally, a variation of the materials utilized on either the inner or outer walls is also possible such as the inclusion or substitution of other materials (rubber, polymer, metal or another plastic) which can modify the generated contact characteristics or the force induced by the physical tensioned type of interaction. Shown are four equally spaced tabs (about the inner wall), a greater or fewer number provides an identical function; a removal of three of the four tabs does not disable the functional operation of the described banding device. Moreover a modification of the tabs inter-spatial distances can be performed. The location of the attached edge can also be varied. The complementary attachment interaction is provided in between threaded connector implements integrated with the container component [11] and the closure component (described as a part of the FIG. 2 and FIG. 4 Detailed Description). Said attachment of the container and closure components is coincident with the opening [10] being covered, which restricts access to said cavity [9]. Other connector implement types can provide said complementary attachment interaction including the plurality of: a lip, tab, snap-on, clip-on, a strip whether static, elastic or Velcro®, crown cap, friction fit, another similar structure, direct fusion or be a combination thereof. Said threaded connector implement and said other connector implements types can be integrated at various sites onto the container component's outer or inner surface or onto the banding device implement. Modifiers such as those described in the FIG. 1 Detailed Description can be included with any of the surfaces.

Figure 4:
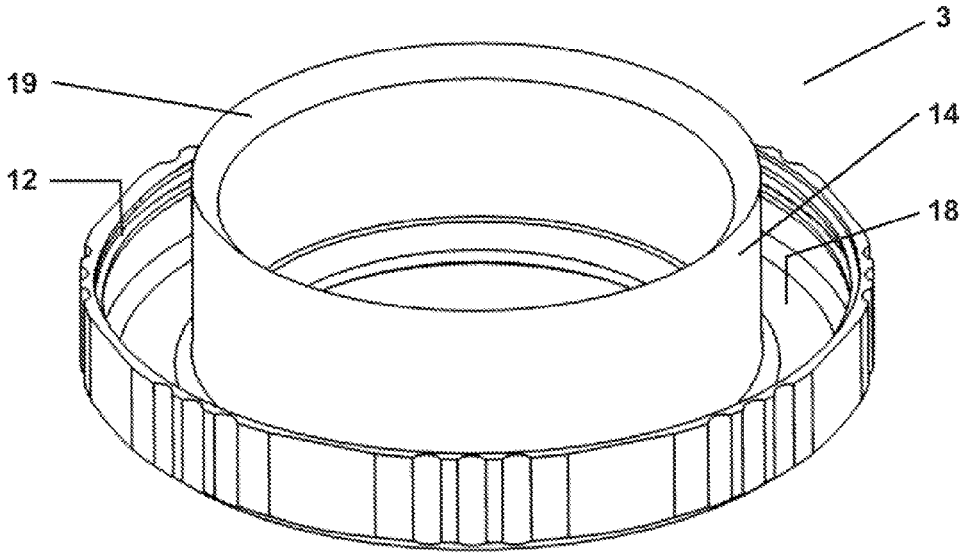
FIG. 4 is a perspective view of the closure component and the inflexible type of banding device implement.

FIG. 4 is a perspective view of the closure component [3] with the attached inflexible type of banding device implement [14]. It is my current belief that the covering of the container component's opening is advantageous, however an environmentally exposed cavity is possible. The closure component of the first embodiment comprises a lid, however other types of closure components are possible, including the plurality of mechanical types including: a flap, a cap, a plug, a fold, another such device or a combination thereof or result as a consequence of said container's situation overtop of said lighting device's outer surface or conform to a chemical or another adhesive type interaction. Said lid construct is formed by a complete or incomplete attachment of walls. A threaded connector implement [12] is integrated which is complementary with the container's threaded connector implement (described as a part of the FIG. 2 and FIG. 3 Detailed Description). Said attachment of the container and closure components is coincident with the container's opening being covered which restricts access to said cavity. Other connector implement types can provide said complementary attachment interaction including the plurality of: a lip, tab, snap on, clip on, a strip whether static, elastic or Velcro®, crown cap, friction fit, another similar structure, direct fusion or be a combination thereof. Said threaded connector implement and said other connector implements types can be integrated at various sites onto the closure component's outer or inner surface or onto the banding implement. The lid contains a base [18] which comprises a horizontal and nearly perpendicular vertical walls. The base covers said opening when the container and closure components are attached and thereby provides a means for said restriction of access to the cavity. The base may be shaped in a variety of manners and may itself contain openings that also comprise a non-continuity in the walls and through which access to the cavity can be provided. Said inflexible type of banding implement [14] arises from a continuation of the vertical wall with a lesser diameter, protrudes away from said horizontal wall with a ring type morphology and is terminated by an angular top limit [19]. Coincident with the rotative appliance of the complementary attachment interaction, said protruded ring motions in a manner partially perpendicular to that of said dimensional reductive motion of the flexible type of banding device implement's movable free edges (described as a part of FIG. 2 and FIG. 3). Post contact of said movable free edges with said lighting device's outer surface, a continued appliance of said complementary attachment interaction induces said stress that leads to said deformation of said bendable length and thereby said physical tensioned type of interaction. The angular top limit termination [19] provides for an increased interaction efficiency with the outer facing wall of the flexible type of banding device implement. Multiple variations to the inflexible type of banding device implement are possible and include, but are not limited to: a height, width, length, thickness or curvature. Additionally, a variation of the materials utilized on either the inner or outer walls is also possible such as the inclusion of other materials (rubber, polymer, metal or another plastic) to modify the interaction characteristics with the flexible type of banding device implement. The attached location of the inflexible type of banding device implement can also be varied. Other banding devices can be utilized such as the plurality including one or more: clamps, clips, snaps, friction tabs, clip tabs, tape or glue, strips whether elastic, static or Velcro®, threaded interactions, another similar mechanism or be a combination thereof. Said physical tensioned type of interaction is of the frictional type however said other types of banding devices can generate a: gravitational, electrostatic, magnetic, chemical interaction or a combination thereof. Modifiers such as those described in the FIG. 1 Detailed Description can be included with any of the surfaces.

DETAILED DESCRIPTION

Alternate Embodiment FIGS.

Figure 5:
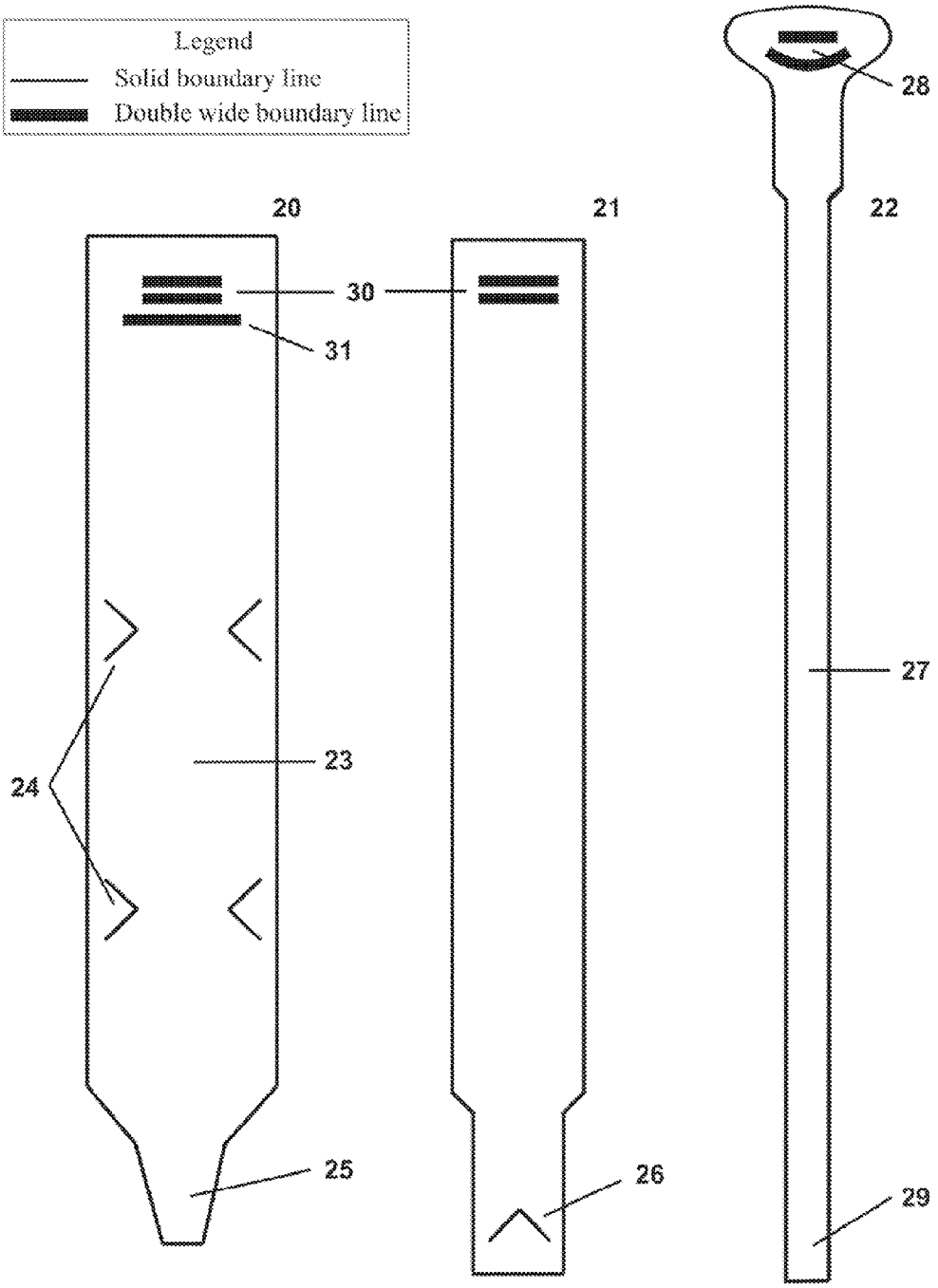
FIG. 5 is a perspective view of an alternate embodiment fabricated from a flexible material where the container component, closure component and the banding device are separated.

FIG. 5 is a perspective view of an alternate embodiment that is fabricated from a flexible material. A container component [20], closure component [21] and a banding device [22] are separated. Said flexible material is typically plastic sheeting, however other flexible materials such as polymers, fabric or paper may be utilized providing that the physical properties are appropriate for a situation overtop of a lighting device's outer surface and maintenance within the operational environment. Said physical properties include, but are not necessarily limited to: an electrical non-conductivity, a heat resistance, a corrosion resistance, a fracture resistance, a light resistance and an optical opacity. The shape and dimensions can be modified. Various lighting devices can provide a platform for said situation including the plurality of, but not necessarily limited to: a light bulb socket, a ballast of a CFL or a covered CFL device, a heat sink of a LED device or another such device utilized in conjunction with lighting. The individual components arise from an incision being made through the plastic sheeting along the solid boundary lines and at the edges of the double wide boundaries. A cavity [23] is formed in between the attached container and closure components with dimensions that allows for an insertion of one or more solid objects (not shown). Said solid objects can be of the plurality including: paper documents, low volatility aromatics such as an air freshener, heat transfer type materials such as metals, ceramics, plastics or semiconductors, insulator type materials against heat, electricity or cold, desiccants or liquids or gases within a protecting shell that is porous, semi-porous or non-porous. An opening is present in between said container and closure components which comprises a non-continuity and provides a means to access said cavity. The opening has dimensions that allows for the insertion the solid objects. One or more additional openings can be present and need not necessarily be of a sufficient size for said insertion of the solid objects. Said closure component covers said opening and simultaneously creates and restricts access to the cavity. It is my current belief that the covering of the container component's opening is advantageous, however an environmentally exposed cavity is possible. An attachment of the container and closure components is provided by a complementary attachment interaction which comprises connector implement slits and a tab incised into the container and closure components. Said slits [24] are passed overtop of the closure component's outer edges and an end-on tab [25] at one terminus end of the container component is passed through the slit [26] in the closure component. The number, position and shape of the slits and tab can be varied. Other connector implements can be utilized to provide said complementary attachment interaction including the plurality of: a lip, snap on, clip on, a strip whether static, elastic or Velcro®, a threaded screw type interaction, crown cap, friction fit, another similar structure, direct fusion or be a combination thereof. The banding device [22] comprises a static strip [27], two slots [28] at one terminal end and a tab [29] at the other. The banding device is attached with the container and closure components by an insertion of the tab [29] through two aligned slots [30]. The attached container and closure components are folded backward and an insertion of the container component's end-on tab [25] into a slot [31] also in the container component, which secures an open cylindrical form (shown in the FIG. 6). The banding device is wrapped about the open cylindrical form and the tab [29] is passed through the two slots [28] in the banding device. A tightening of the banding device generates contact with the lighting device's outer surface. A further tightening induces a physical tensioned type of interaction that is of a sufficient force for maintenance of the open cylindrical form in said situated location. Other banding devices can be utilized such as the plurality including one or more: clamps, clips, snaps, friction tabs, clip tabs, tape or glue, a strips whether static, elastic or Velcro®, threaded interactions, another similar mechanism or be a combination thereof. Said physical tensioned type of interaction is of the frictional type however said other types of banding devices can generate a: gravitational, electrostatic, magnetic, a chemical type of interaction or be a combination thereof. Onto any surface modifiers can be integrated including the plurality of: external surface modifiers such as script, glued or plasticized labels or internal modifiers integrated during fabrication or that result from a post fabrication process such as surface finishes, thermal or light resistant coatings, raised or recessed lettering or other symbols.

Figure 6:
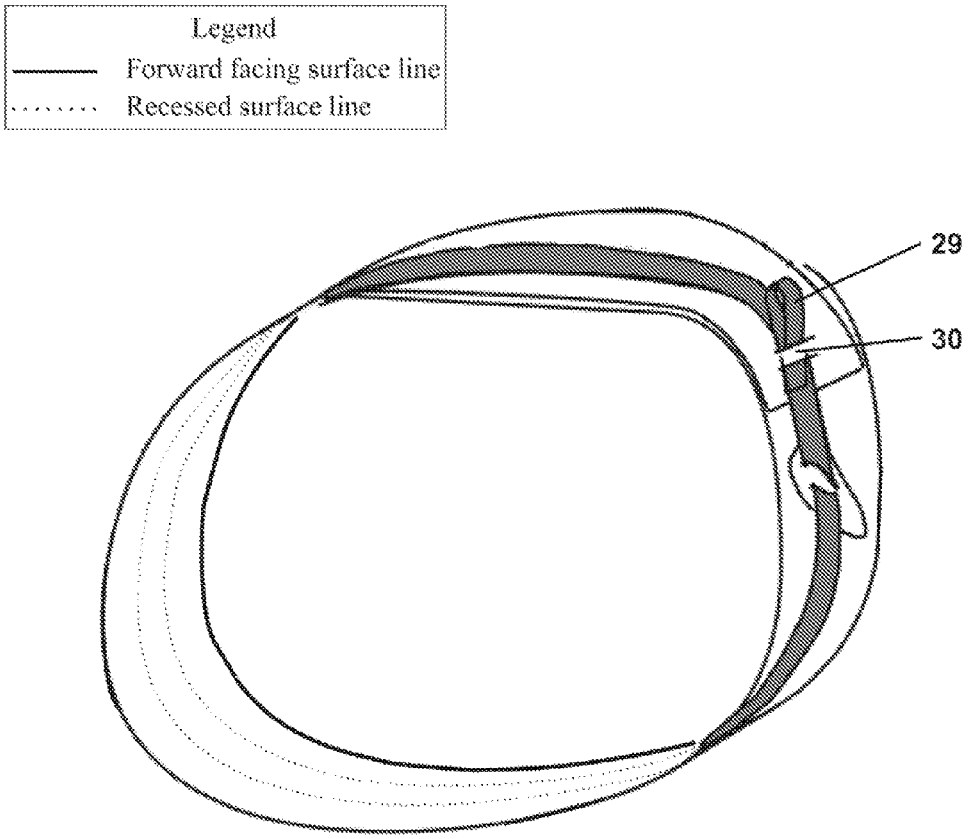
FIG. 6 is a perspective view of the separated component alternate embodiment fully attached for situation overtop of the lighting device's outer surface.

FIG. 6 is a perspective view of the connected separated component alternate embodiment. The open cylindrical form has a central free space with a diameter that allows for said situation overtop of said lighting device's outer surface. The banding device's tab [29] is folded over and reinserted through the two aligned slots [30] in the attached container and closure components which secures its position.

Figure 7:
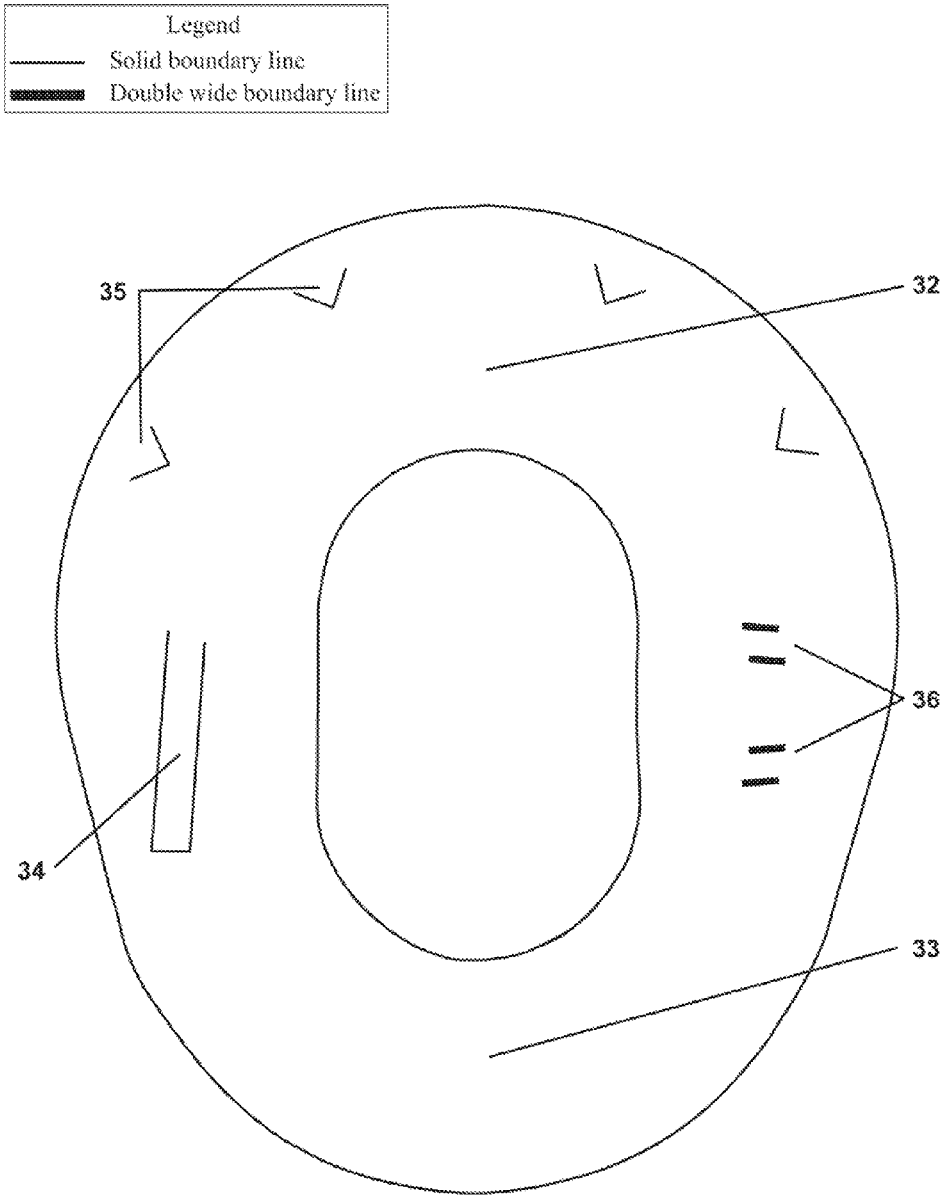
FIG. 7 is a perspective view of an alternate embodiment fabricated from a flexible material where the container component, closure component and the banding device are associated.

FIG. 7 is a perspective view of an alternate embodiment that is fabricated from a flexible material and comprises a single piece that contains the container component,[32] closure component [33] and banding device [34]. Said flexible material is typically plastic sheeting, however other flexible materials such as polymers, fabric or paper may be utilized providing that the physical properties are appropriate for a situation overtop of a lighting device's outer surface and maintenance within the operational environment. Said physical properties include, but are not necessarily limited to: an electrical non-conductivity, a heat resistance, a corrosion resistance, a fracture resistance, a light resistance and an optical opacity. The shape and dimensions can be modified. Various lighting devices can provide a platform for said situation including the plurality of, but not necessarily limited to: a light bulb socket, a ballast of a CFL or a covered CFL device, a heat sink of a LED device or another such device utilized in conjunction with lighting. The individual components arise from an incision being made through the plastic sheeting along the solid boundary lines and at the edges of the double wide boundaries. An opening over the entire face is covered by the closure component which can be folded along the equatorial boundary overtop of the container component. Said folding creates the cavity in between the container and closure component which has dimensions that allows for one or more solid objects to be inserted. One or more additional openings can be present and need not necessarily be of a sufficient size for said insertion of said solid objects. Said solid objects can be of the plurality including: paper documents, low volatility aromatics such as an air freshener, heat transfer type materials such as metals, ceramics, plastics or semiconductors, insulator type materials against heat, electricity or cold, desiccants or liquids or gases within a protecting shell that is porous, semi-porous or non-porous. An attachment of the container and closure components is provided by a complementary attachment interaction that comprises connector implement tabs [35] which are passed overtop of the closure component's outer edge. Other connector implements can be utilized to provide said complementary attachment interaction including the plurality of: a lip, snap on, clip on, a strip whether static, elastic or Velcro®, a threaded screw type interaction, crown cap, friction fit, another similar structure, direct fusion or be a combination thereof. The banding device [34] comprises a static strip. Following said closure of the container by said equatorial folding and a wrapping in a conical fashion, the banding implement can be inserted through two slots [36] that are aligned. Said insertion secures the container and closure components into an end-on open truncated conical form (shown in FIG. 8). A tightening of the banding device generates a contact with the lighting device's outer surface. A further tightening induces a physical tensioned type of interaction that is of a sufficient force for maintenance of the end-on open truncated conical form in said situated location. Other banding devices can be utilized such as the plurality including one or more: clamps, clips, snaps, friction tabs, clip tabs, tape or glue, strips whether static, elastic or Velcro®, threaded interactions, another similar mechanism or be a combination thereof. Said physical tensioned type of interaction is of the frictional type however said other types of banding devices can generate a: gravitational, electrostatic, magnetic, a chemical type interaction or be a combination thereof. Onto any surface modifiers can be integrated including the plurality of: external surface modifiers such as script, glued or plasticized labels or internal modifiers integrated during fabrication or that result from a post fabrication process such as surface finishes, thermal or light resistant coatings, raised or recessed lettering or other symbols.

Figure 8:
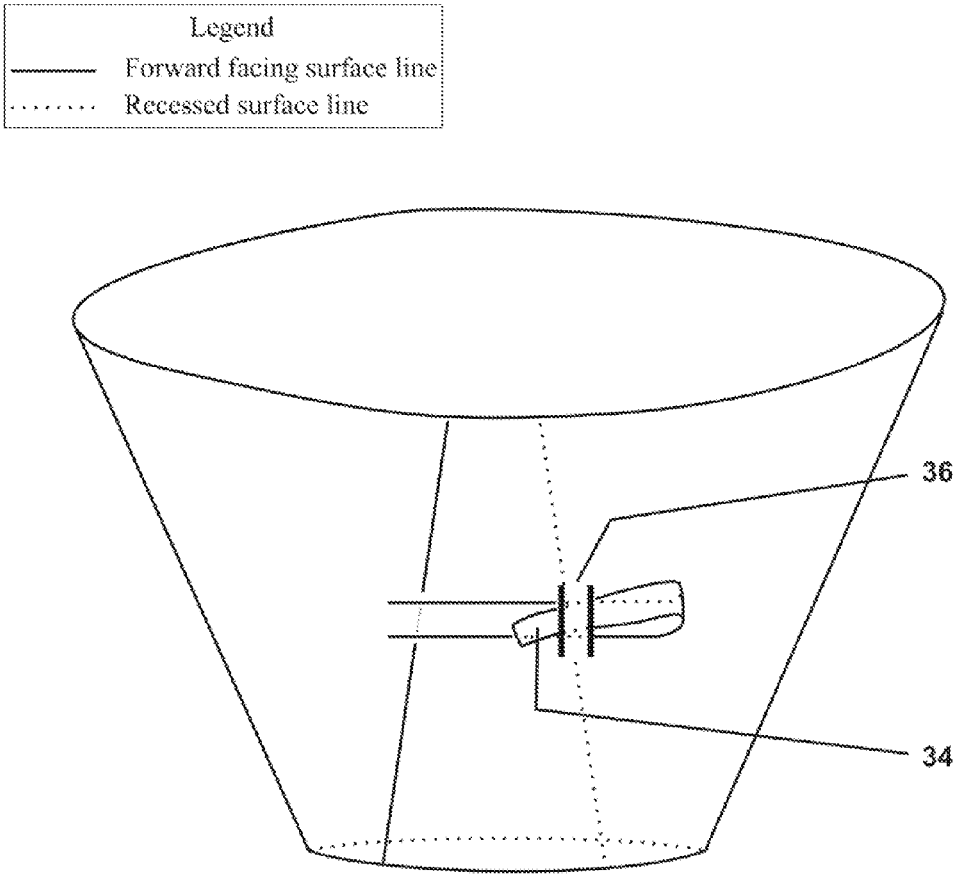
FIG. 8 is a perspective view of the associated component alternate embodiment fully attached for situation overtop of a lighting device's outer surface.

FIG. 8 is a perspective view of the connected associated component alternate embodiment. The end-on opened truncated conical form has a central free space with a diameter that allows for said situation overtop of said lighting device's outer surface. The banding device [34] is folded over and reinserted through the two aligned slots [36] which secures its position.

CONCLUSION, RAMIFICATIONS AND SCOPE

An invention has been described which can be situated with one or more solid objects, typically paper documents overtop of a lighting device's outer surface. A container component contains an opening that provides access to a cavity. By means of a complementary attachment interaction, a closure component attaches with the container component covering the opening and thereby restricting access to the cavity. A banding device maintains the container component, closure component, the banding device itself and said one or more solid objects at said situated location overtop of a lighting device's outer surface.

The invention claimed is:

1. A self contained device that comprises:

a container component;

and a banding device;

said container component contains a cavity that can be accessed through one or more openings;

said cavity and at least one of said one or more openings have dimensions that allow for an insertion of one or more solid objects;

said banding device provides a means for a situation and a maintenance of said one or more solid objects within said cavity overtop of a lighting device's outer surface;

access to said cavity can be restricted by means of a closure component that provides a means to cover one or more of said openings;

said container component and said closure component are attached by means of a complementary attachment interaction;

whereby said situation and maintenance of the container component, closure component and the banding device itself is provided overtop of the lighting device's outer surface by said banding device with said one or more solid objects within said cavity.

2. The apparatus of claim 1 wherein said container component comprises:

a construction fabricated from walls numbering one or more in quantity that are completely or incompletely attached at their edges;

said one or more walls are composed of a material that is appropriate for said maintenance in said situated location;

said cavity comprises a spatial void incompletely surrounded by said walls;

said one or more openings comprise a non-continuity in said walls;

one or more connector implements interact with one or more of said walls and comprise a partial complement of said complementary attachment interaction;

with any of said one or more walls surface finishes and modifiers can be included.

3. The apparatus of claim 1 wherein said closure component comprises:

a construction fabricated from walls numbering one or more in quantity that are completely or incompletely attached;

said one or more walls are composed of a material that is appropriate for said maintenance is said situated location;

one or more of said walls cover one or more of said openings in the container component and thereby access to said cavity is restricted;

one or more connector implements interact with one or more of said walls and comprise a partial complement of said complementary attachment interaction;

with any of said one or more walls surface finishes and modifiers can be included.

4. The apparatus of claim 1 wherein said banding device comprises:

one or more types of implement fabricated from one or more walls;

said one or more types of implement are composed of a material that is appropriate for said maintenance in said situated location;

a means to generate physical contact with an induction of a physical tensioned type of interaction with said lighting device's outer surface;

said physical tensioned type of interaction has a force sufficient for said maintaining of said container component, one or more solid objects, said closure component and the banding device itself in said situated location;

said one or more types of banding device implement can be attached with either or both of the container and closure components;

said generation physical contact and said induction of the physical tensioned type of interaction is possible with outer surfaces of a varied size;

with any of said one or more walls surface finishes and modifiers can be included.

5. The apparatus of claim 1 wherein said lighting device is selected from the group comprising of a light bulb socket, a ballast, a heat sink or another such device utilized in conjunction with lighting.

* * * * *